US010168131B2

(12) United States Patent
Riess

(10) Patent No.: US 10,168,131 B2
(45) Date of Patent: Jan. 1, 2019

(54) PARTIALLY DIVIDING PROJECTILE OR DIVIDING PROJECTILE WITH A PB-FREE CORE INTERSPERSED WITH PREDETERMINED BREAKING POINTS

(71) Applicant: RUAG AMMOTECH GMBH, Fuerth (DE)

(72) Inventor: Heinz Riess, Fuerth (DE)

(73) Assignee: RUAG AMMOTEC GMBH, Fürth (DE)

( * ) Notice: Subject to any disclaimer, the term of this patent is extended or adjusted under 35 U.S.C. 154(b) by 0 days.

(21) Appl. No.: 14/358,892

(22) PCT Filed: Nov. 30, 2012

(86) PCT No.: PCT/EP2012/074128

§ 371 (c)(1),
(2) Date: Jun. 11, 2014

(87) PCT Pub. No.: WO2013/079679

PCT Pub. Date: Jun. 6, 2013

(65) Prior Publication Data

US 2014/0283707 A1 Sep. 25, 2014

(30) Foreign Application Priority Data

Dec. 1, 2011 (DE) ..... 10 2011 119 822
Jun. 26, 2012 (DE) ..... 10 2012 012 538

(51) Int. Cl.
*F42B 12/02* (2006.01)
*F42B 12/34* (2006.01)
(Continued)

(52) U.S. Cl.
CPC ..... *F42B 12/367* (2013.01); *F42B 12/02* (2013.01); *F42B 12/34* (2013.01); *F42B 12/74* (2013.01); *F42B 33/00* (2013.01)

(58) Field of Classification Search
CPC ..... F42B 12/02; F42B 12/34; F42B 12/74; F42B 12/367; F42B 33/00; F42B 12/36; H01F 7/06; H01F 41/00; H01F 27/00
(Continued)

(56) References Cited

U.S. PATENT DOCUMENTS 219,840 A 9/1879 Winchester
3,097,603 A * 7/1963 Harper ..... 102/506
(Continued)

FOREIGN PATENT DOCUMENTS

FR 1 274 688 A 10/1961
GB 2203621 A * 10/1988 ..... A01K 95/00
(Continued)

OTHER PUBLICATIONS

Written Opinion of the International Searching Authority for PCT/EP2012/074128; dated Jun. 1, 2014.*

*Primary Examiner* — James S Bergin
(74) *Attorney, Agent, or Firm* — Norton Rose Fulbright US LLP; James R. Crawford

(57) ABSTRACT

The invention relates to a method for producing a core (1) for a projectile (2). So that the dividing behavior of the projectile can be set in a simple manner, wherein the core is lead-free, it is proposed that one or more wires or wire sections composed of a lead-free material are compressed to form a cavity-free core (1), wherein the wires or wire sections have one or more geometrical shapes (3) in the interior or on the outside diameter and/or predetermined braking points (4) obtained during the compression are provided in the core (1).

3 Claims, 11 Drawing Sheets

(51) Int. Cl.
*F42B 12/36* (2006.01)
*F42B 12/74* (2006.01)
*F42B 33/00* (2006.01)

(58) Field of Classification Search
USPC ..... 102/506, 507, 516, 517; 29/605–607; 86/54, 55
See application file for complete search history.

(56) References Cited

U.S. PATENT DOCUMENTS 3,208,386 A * 9/1965 Schneider et al. ..... 102/506
3,613,179 A * 10/1971 Whittaker W ..... F16G 11/02 24/302
4,882,822 A * 11/1989 Burczynski ..... F42B 12/34 102/501
4,947,755 A * 8/1990 Burczynski ..... F42B 12/34 102/501
5,394,597 A * 3/1995 White ..... F42B 12/78 102/514
5,454,325 A * 10/1995 LeBlanc ..... 102/506
5,528,989 A * 6/1996 Briese ..... 102/506
5,569,874 A * 10/1996 Nelson ..... 102/507
5,679,920 A * 10/1997 Hallis et al. ..... 102/506
5,852,255 A * 12/1998 Hallis et al. ..... 102/439
5,852,858 A 12/1998 Hallis et al.
5,894,645 A 4/1999 Hallis et al.
6,024,021 A 2/2000 Schultz
6,581,522 B1 * 6/2003 Julien ..... F42B 5/192 102/430
6,938,552 B2 * 9/2005 Tom et al. ..... 102/517
7,406,906 B2 * 8/2008 Beal ..... 86/54
2003/0145755 A1 8/2003 Briese
2008/0141890 A1 6/2008 Beal
2015/0292845 A1 * 10/2015 Riess ..... F42B 12/34 102/506

FOREIGN PATENT DOCUMENTS

WO 01/20244 A1 3/2001
WO 01/20245 A1 3/2001

* cited by examiner

PARTIALLY DIVIDING PROJECTILE OR DIVIDING PROJECTILE WITH A PB-FREE CORE INTERSPERSED WITH PREDETERMINED BREAKING POINTS

This application is a § 371 of International Application No. PCT/EP2012/074128 filed Nov. 30, 2012, and claims priority from German Patent Application No. 10 2011 119 822.2 filed Dec. 1, 2011, and German Patent Application No. 10 2012 012 538.0 filed Jun. 26, 2012.

The invention relates to a method for producing a core for a projectile and to a partially dividing projectile or a dividing projectile.

It is an object of the invention to provide a method for producing a core for a projectile by means of which the dividing behavior of the projectile can be set in a simple manner. The core shall be lead-free.

This object is characterized according to the invention in that one or more wires or wire sections made from a lead-free material are compressed so as to form cavity-free core, wherein the wires or wire sections have one or more geometrical shapes in the interior or on the outer diameter, and/or specific predetermined breaking points are incorporated in the core during compressing. The dividing behavior can be set through the number of predetermined breaking points. See explanation below.

The core (1) is pressed separately into a cavity-free core and is subsequently anchored in the projectile, or is inserted as a wire section directly into the projectile jacket (5) and is compressed in the projectile jacket so as to form a cavity-free core (1).

The core can be pressed separately into a cavity-free core and can subsequently be anchored in the projectile or can be inserted as a wire section directly into the projectile jacket and can be compressed in the projectile jacket so as to form a cavity-free core.

In an embodiment according to the invention, a press punch that is structured on its pressing side is used for pressing. The structures are formed here in such a manner that they create predetermined breaking points in the core.

The structuring preferably consists of needles that penetrate into the core during pressing and thereby create the predetermined breaking points.

The dividing capability is set via the length of the needles. Relevant is here how far the needles penetrate into the core during pressing. If the needles extend completely through the core during pressing, the dividing behavior with regard to these needles is at a maximum, i.e., 100%. Through the number of penetrating needles can be set which volume or which parts of the core are provided with predetermined breaking points.

In an alternative configuration, the wires or wire sections have slots or holes in the interior, and/or have slots on the outer diameter of the wire that are incorporated from the outside. These slots or holes create the predetermined breaking points during pressing.

A dividing projectile or partially dividing projectile according to the invention that has at least one core with predetermined breaking points and is produced with the above-described method is characterized in that the projectile, in addition to the core that has predetermined breaking points, has at least one solid core, i.e., a core made of solid material without predetermined breaking points, wherein the core that has predetermined breaking points is arranged before or behind the solid core (partially dividing projectile), or only cores that have predetermined breaking points are arranged next to each or one behind the other in the projectile (dividing projectile).

DESCRIPTION OF THE PROJECTILE CORE

The dividable core in the projectile is interspersed with predetermined breaking points. The core can comprise the predetermined breaking points with regard to its longitudinal direction in the axial or radial direction or can comprises a combination of both directions. Preferably, there can be between 1 and 100 predetermined breaking points in the core in the axial or radial direction, or in both directions together. Upon impact, the predetermined breaking points in the core ensure a defined dividing and determine the size of the individual parts (splinters). Here, the rule applies: low number of predetermined breaking points—large individual parts, high number of predetermined breaking points—small individual parts.

DESCRIPTION OF THE WIRE OR THE WIRE SECTION

The core is produced by compressing or compressing a wire or individual wire sections. The endless wire or wire section consists of a Pb-free material, e.g., Sn, Zn, etc., that can be pressed into a cavity-free core at a pressing force of preferably 1-6 t. In the core, all conceivable types of geometrical shapes can be contained such as, e.g., holes, oblong holes, webs, star-shaped arrangement, etc., which, after pressing, occur as predetermined breaking points in the core.

The incorporated geometrical shapes can be provided in the interior or on the outer diameter of the wire. The shapes can be provided in the axial or radial direction, or in both directions.

INCORPORATING THE PREDETERMINED BREAKING POINTS INTO THE PROJECTILE CORE

The Pb-free compressible material used for the core consists of an endless wire or wire section with incorporated shapes in the axial and/or radial direction. The geometrical shapes can be provided in the interior or on the outside of the wire, or both. The wire is pressed separately so as to form a cavity-free core and is subsequently anchored in the projectile or inserted as a wire section directly into the projectile and is compressed in the projectile so as to form a cavity-free core. The pressure depends on the hardness of the core jacket and preferably ranges between 1.0 and 6 tons.

Due to the compression, the geometrical shapes incorporated in the wire disappear; however, they remain as predetermined breaking points in the core in order to ensure defined dividing of the core.

MODE OF ACTION

The dividing of a projectile in the target body, in particular of a hunting projectile in the game body after penetrating into the body determines the energy output of the projectile and therefore the effect of the shot. Light game, for example, may require different dividing than heavy game. This can be a semi-jacketed projectile but also a fully dividing jacketed projectile, the projectile core of which consists of a dividable core. Materials suitable for a dividable core are all Pb-free materials such as, e.g., Sn, Zn, which can be compressed so as to form a cavity-free core.

The compressed projectile core that comprises predetermined breaking points and is held by the projectile jacket fragments together with the projectile jacket upon impact on the target body. The predetermined breaking points in the core hereby determine the energy output and therefore the size of the individual parts resulting from the dividing of the core. Larger individual parts penetrate deeper into the medium and cause a destruction channel that penetrates deeper into the tissue than a number of smaller individual parts that is comparable in terms of the mass.

The size of the individual parts is controlled via the number of predetermined breaking points: low number of predetermined breaking points—large individual parts, high number of predetermined breaking points—small individual parts.

With the method according to the invention, the dividing behavior of a projectile comprising a dividable Pb-free core is improved.

A partially dividing projectile has a solid core, i.e., a core from solid material without predetermined breaking points in the tail part or in the projectile nose, comparable with the projectiles that are known from WO 01/20244 A1 or WO 01/20245 A1, and a second core that is interspersed with predetermined breaking points and that is located before or behind the solid core. The solid core and the core comprising predetermined breaking points can be made from different materials suited for projectiles, whereby, however, when shaping the cores, the optimum center of gravity position with regard to ballistics has to be ensured. The dividing projectile only comprises the core interspersed with predetermined breaking points, or a plurality of cores comprising predetermined breaking points, which cores are arranged next to one another or one behind the other within the jacket. The number of the individual parts and the size depend on the desired energy output and penetration in the game body.

Large individual parts, deep penetration.

Small individual parts, less penetration into the game body.

If dividing of the projectile is desired already upon impact or at minor penetration depth or at low projectile speeds, the predetermined breaking points in the core are of advantage. The predetermined breaking points run in the axial or radial direction and lie within the geometry of the core. Dividing of the projectile is influenced by the number and the position of the predetermined breaking points in the core.

The described structure of the projectile core is suitable for all projectile types that can be partially divided or fully divided. Through the shown configuration possibilities, a core of a projectile can be produced that is attuned for the respective intended use and that, at any impact speed, achieves in each case an optimal effect due to is attuned dividing behavior.

In an embodiment according to the invention, the projectile core with its predetermined breaking points can be produced using a pressing method. This takes place as follows:

1) A wire section is compressed in a die using a punch. On the front region of the punch, geometries or structures are incorporated which, during pressing the projectile core, reproduce the geometries incorporated at the punch and thus form predetermined breaking points. The reproduced geometrical shapes can be provided on the inside or the outside or on both sides together in the axial direction on the projectile core. The same geometries as already described above can be provided in the wire. The desired proportional dividing of the projectile core is controlled via the depth of the pressed-in predetermined breaking points; the dividing rate ranges between 5% and 100% (FIGS. 8 and 9). For example, needles can be arranged on the punch, where they penetrate into the projectile core during pressing and thereby create the predetermined breaking points. Dividing is set depending on the length of the needles. FIG. 8 shows a dividing rate of 100%, i.e., the needles protrude completely through the projectile core in the longitudinal direction. FIG. 9 shows a dividing rate of 10%, i.e., the needles protrude through the projectile core in the longitudinal direction only up to a depth of 10%.

2) In an alternative formation, one or more wire sections are inserted into a projectile jacket and compressed using a punch as described under point 1 (see FIGS. 10 and 11). Subsequently, the projectile blank is processed using the usual method until the finished projectile is formed.

The invention is explained in greater detail by means of exemplary embodiments.

In the figures, schematically:

Figure 7A:
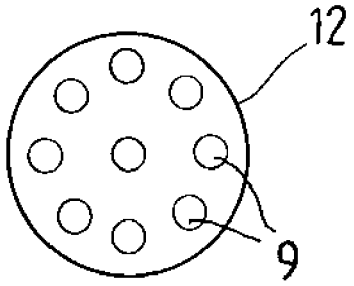
Figure 7B:
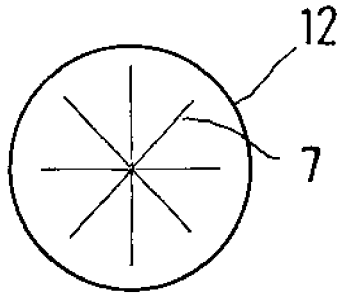
Figure 7C:
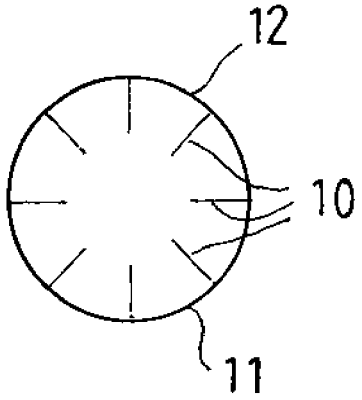

FIGS. 7*a-c* shows examples for shapes incorporated into the Pb-free wire.

Figure 8:
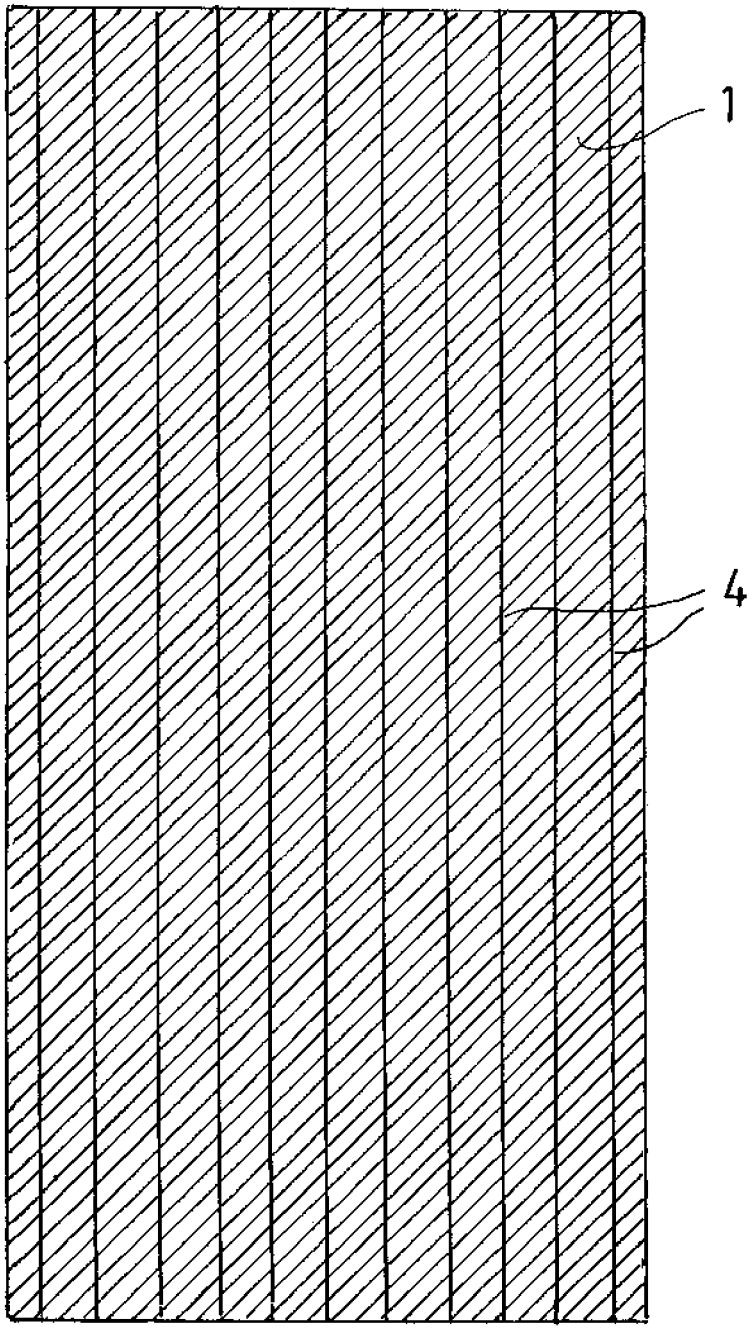

FIG. 8 shows a projectile core that has predetermined breaking points extending in the longitudinal direction and a dividing rate of 100%.

Figure 9:
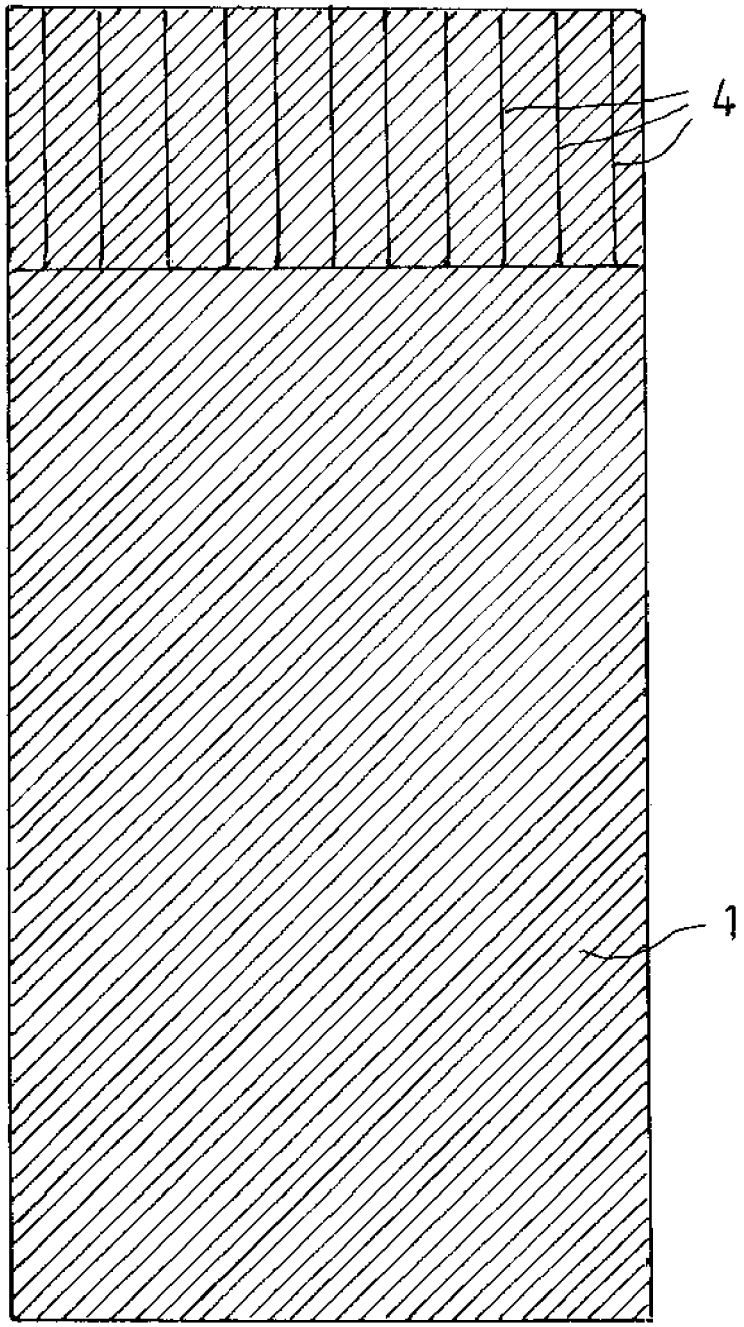

FIG. 9 shows a projectile core that has predetermined breaking points extending in the longitudinal direction and a dividing rate of 10%.

Figure 10:
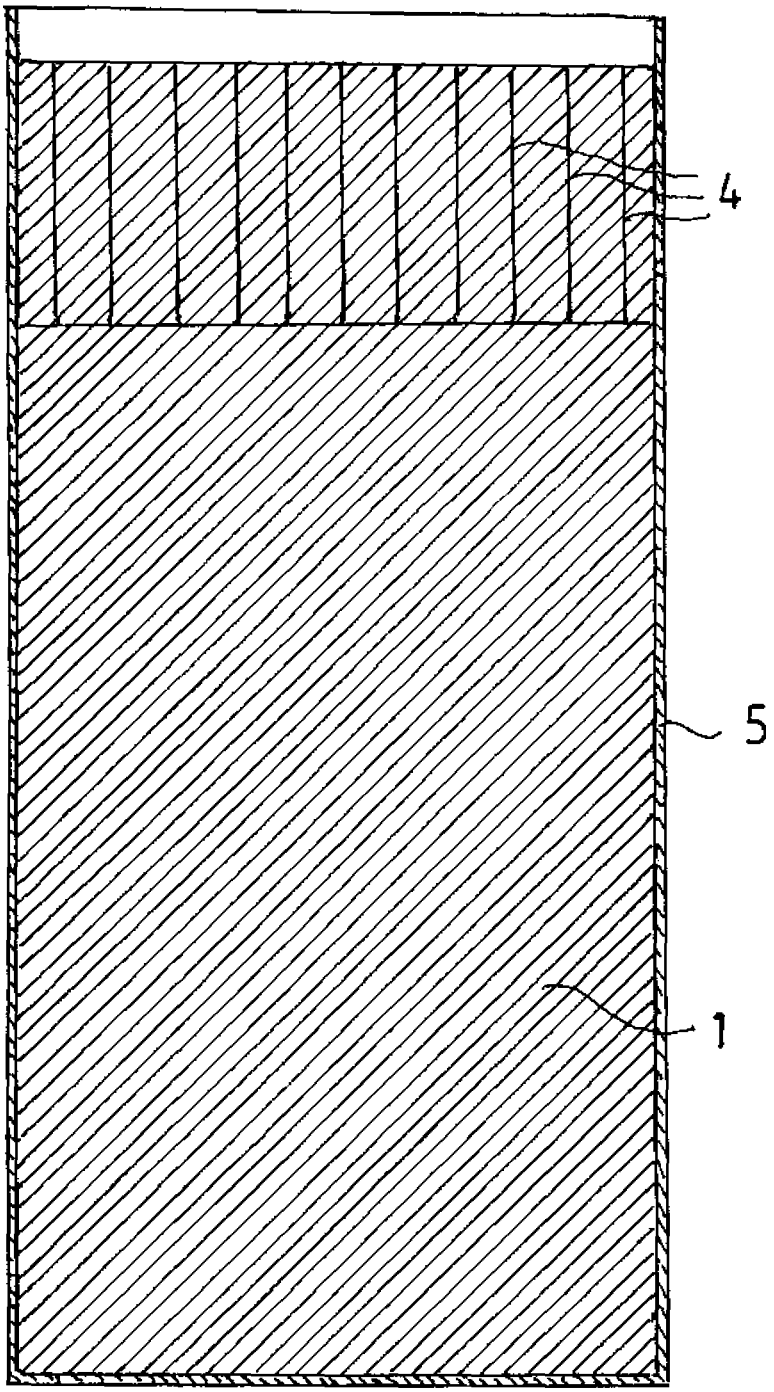

FIG. 10 shows a projectile jacket with a projectile core that is compressed in the projectile jacket and has predetermined breaking points extending in the longitudinal direction and a dividing rate of 10%.

Figure 11:
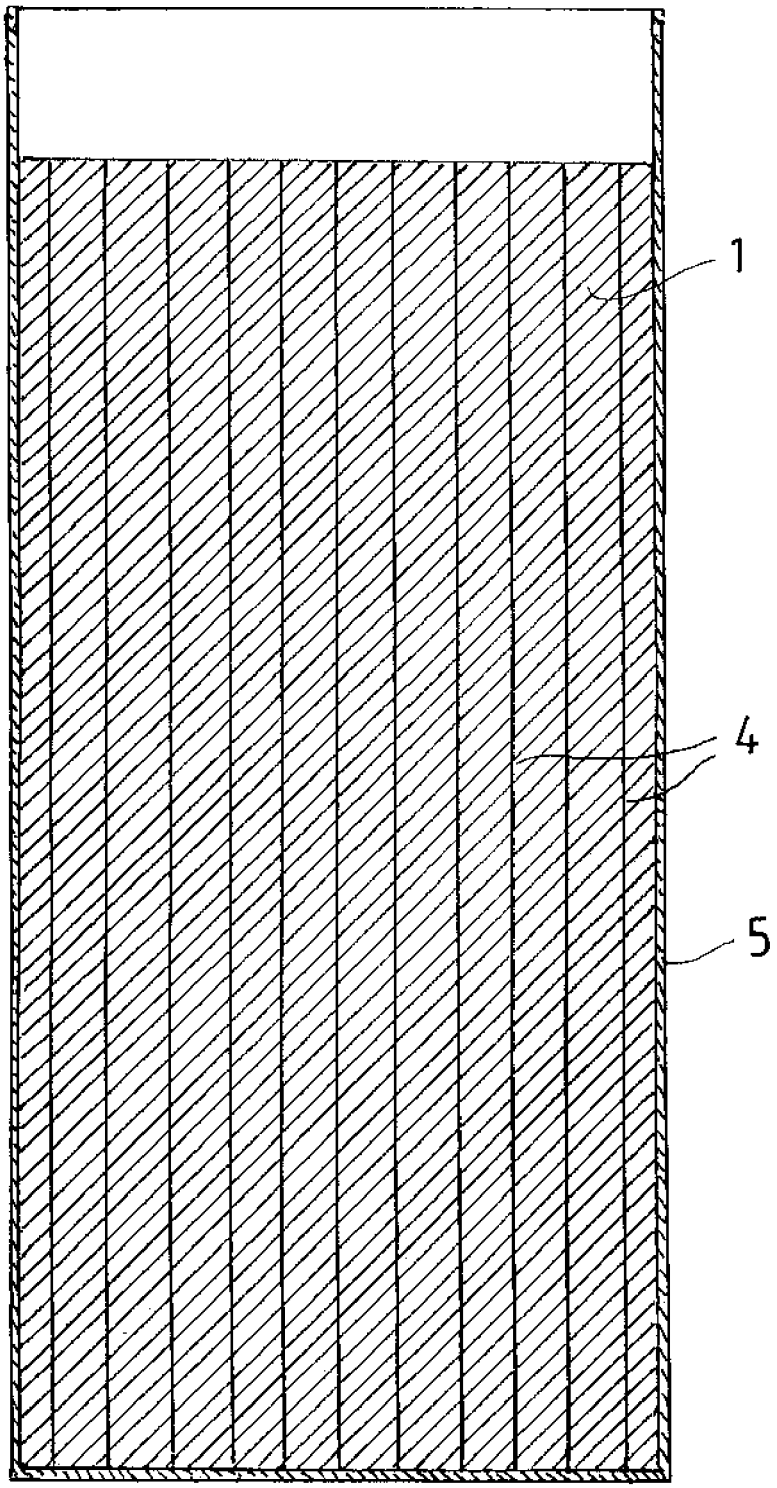

FIG. 11 shows a projectile jacket with a projectile core that is compressed in the projectile jacket and has predetermined breaking points extending in the longitudinal direction and a dividing rate of 100%.

Figure 1:
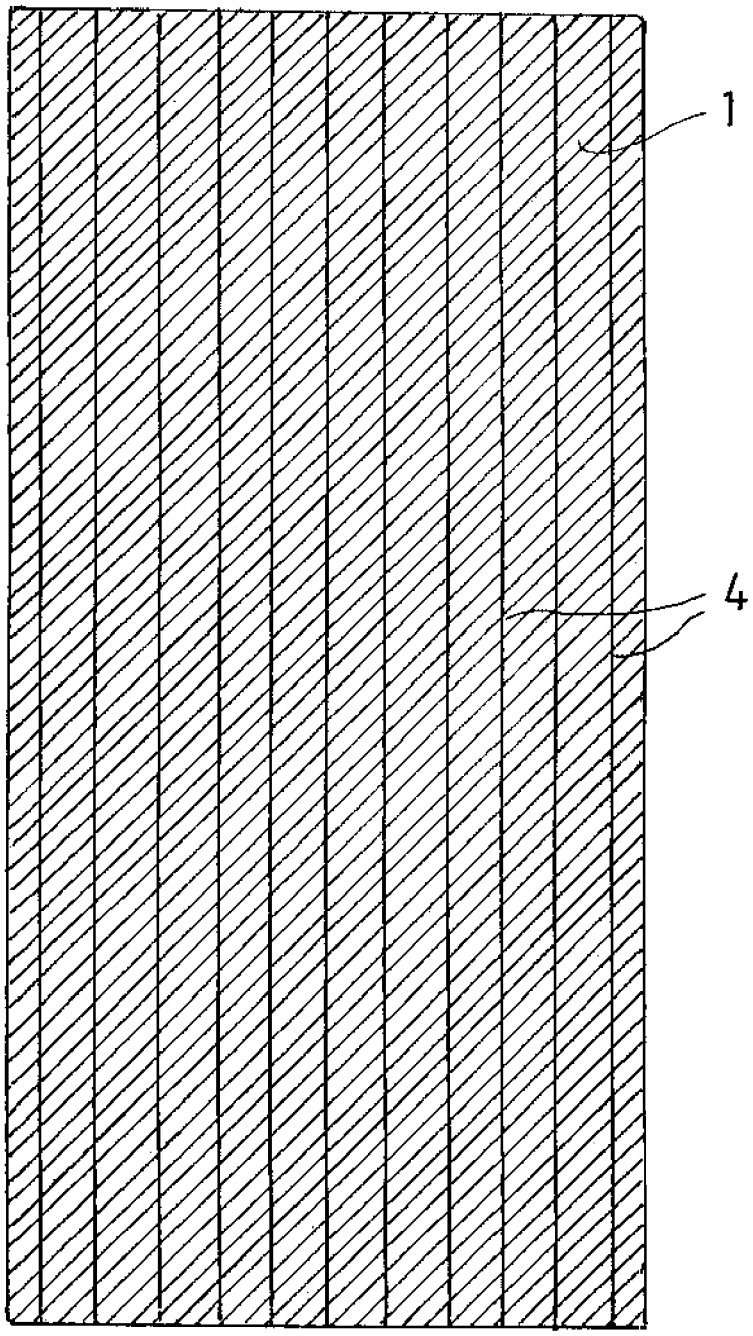
FIG. 1 shows a core that has axial predetermined breaking points.

In FIG. 1, the predetermined breaking points 4 provided in the core 1 are arranged in the axial direction; they are created by compressing the wire comprising the incorporated shapes.

Figure 2:
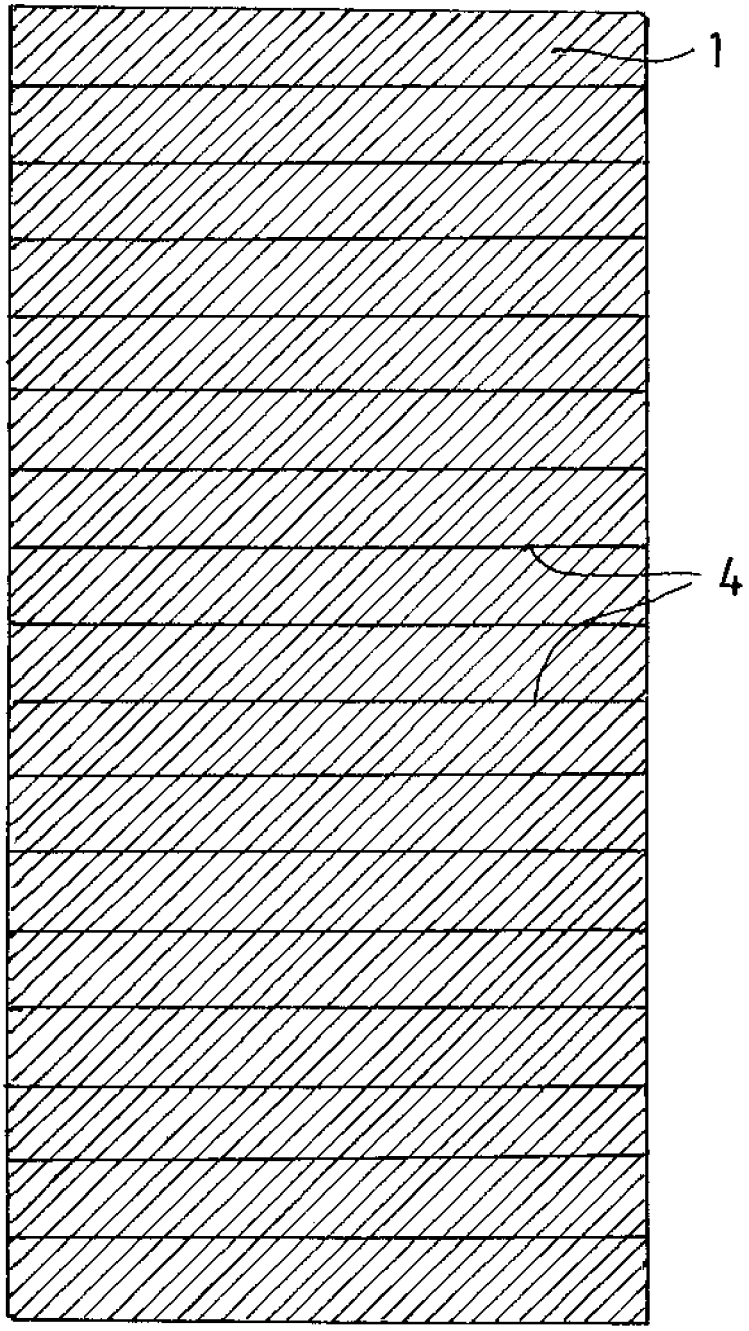
FIG. 2 shows a core that has radial predetermined breaking points.

FIG. 2 corresponds to FIG. 1, but with radial predetermined breaking points 4.

Figure 3:
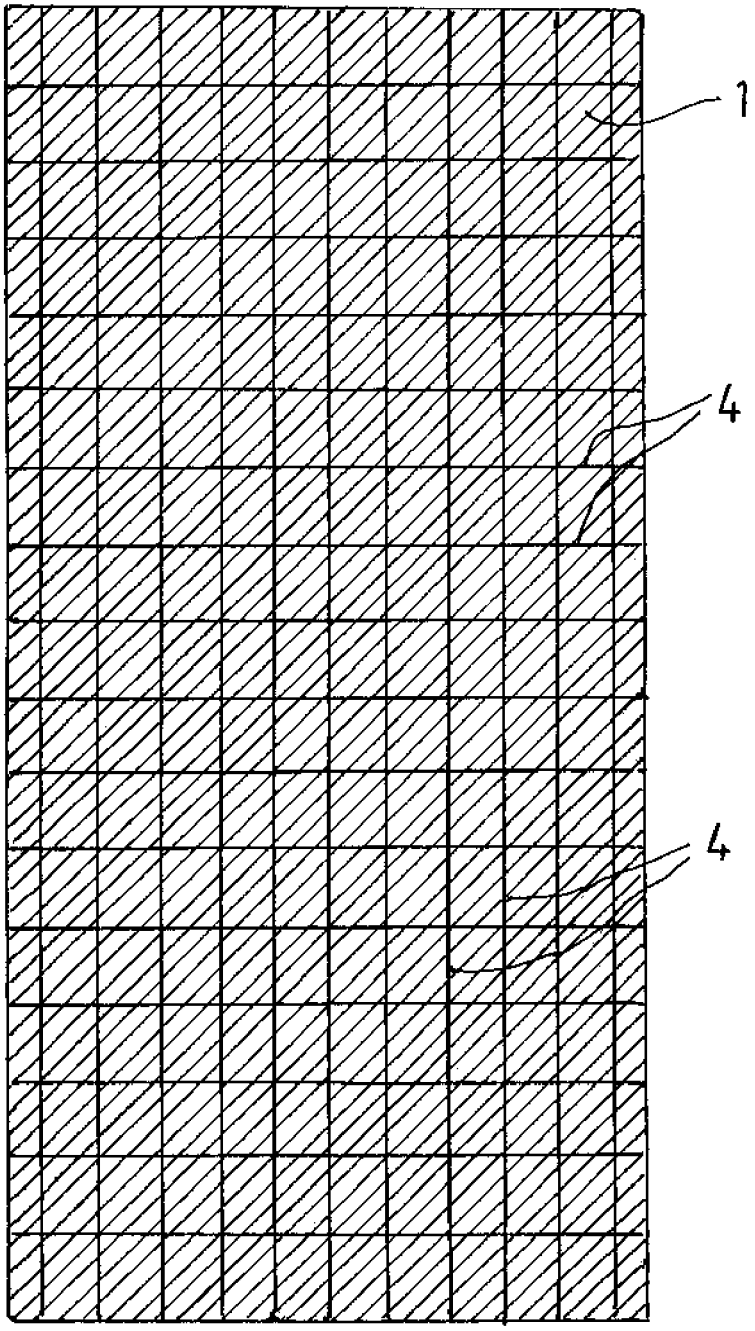
FIG. 3 shows a core that has axial and radial predetermined breaking points.

FIG. 3 corresponds to FIG. 1, but with axial and radial predetermined breaking points 4.

Figure 4:
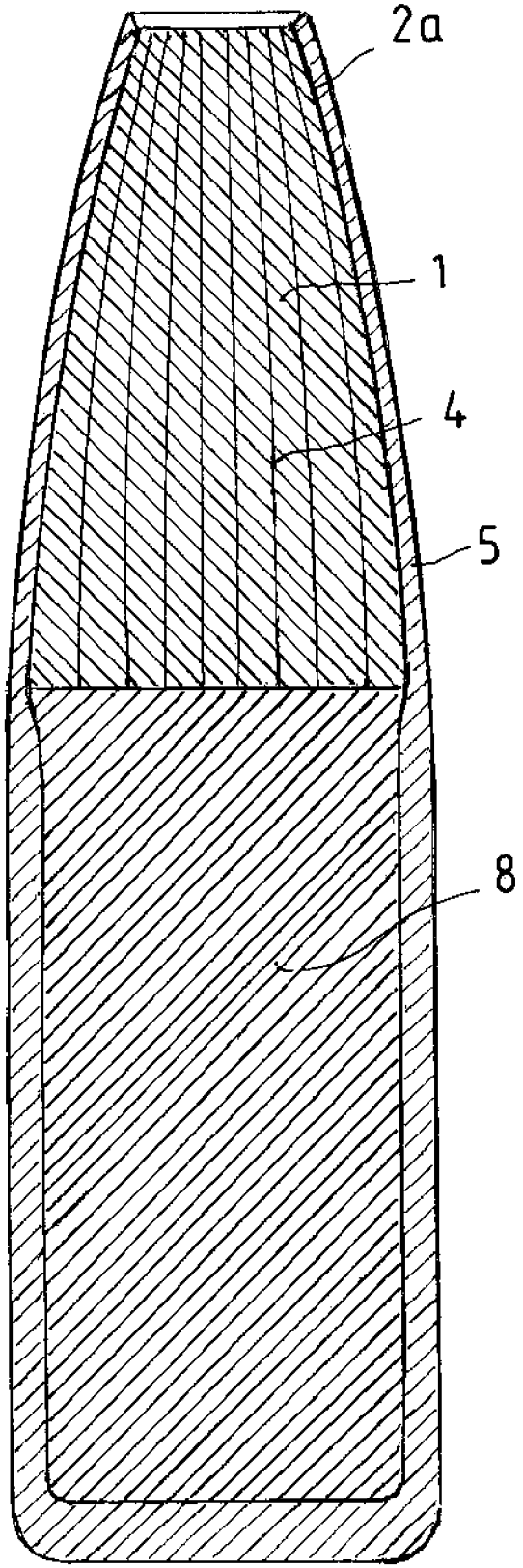
FIG. 4 shows a semi-jacketed projectile as a partially dividing projectile, one half illustrated in a cross-sectional view, comprising a solid tail core and a tip core with interspersed predetermined breaking points.

In FIG. 4, a semi-jacketed projectile or partially dividing projectile 2*a* is illustrated. In the initially undeformed open projectile jacket 5, a solid core 8 from a material suitable for a projectile core was inserted. A core 1 with predetermined breaking points 4 was pressed on top of the solid. All Pb-free (lead-free) compressible materials are suitable as materials. Subsequently, the projectile jacket 5 was necked so as to form the illustrated projectile shape. The projectile jacket 5 is not closed at the projectile tip.

When shooting, after opening the projectile jacket, the pressed core 1 with the predetermined breaking points 4 divides into its individual parts and thereby transmits the desired energy into the game. From shot to shot with the same caliber, projectile weight, speed and distance, the energy output by the pressed core 1 into the game is always the same. This type of projectile is speed-independent because the pressed core 1 divides itself at high or low speed.

The proportions in terms of size of the two cores 1, 8 depend on the desired shock effect and penetration into the game body.

At a 50% weight proportion of the pressed core 1, which has the predetermined breaking points 4, based on the total weight of all cores 1 and 8, a high shock effect with a penetration according to the size of the individual parts is obtained.

At a 20% weight proportion of the pressed core 1, which has the predetermined breaking points 4, based on the total weight of all cores 1 and 8, a low shock effect with a penetration according to the size of the individual parts is obtained, but with less destruction of game.

The exemplary embodiment according to FIG. 2 (dividing projectile) is comparable with FIG. 1 in terms of the mode of action. The difference is that the core is one piece and the projectile divides itself completely.

The embodiment of FIG. 3 is comparable with that of FIG. 2. The difference is that the projectile core consists of a plurality of cores that have interspersed predetermined breaking points 4 arranged one above the other. The advantage is that the subdivided whole core 1 divides itself in smaller individual parts.

Figure 5:
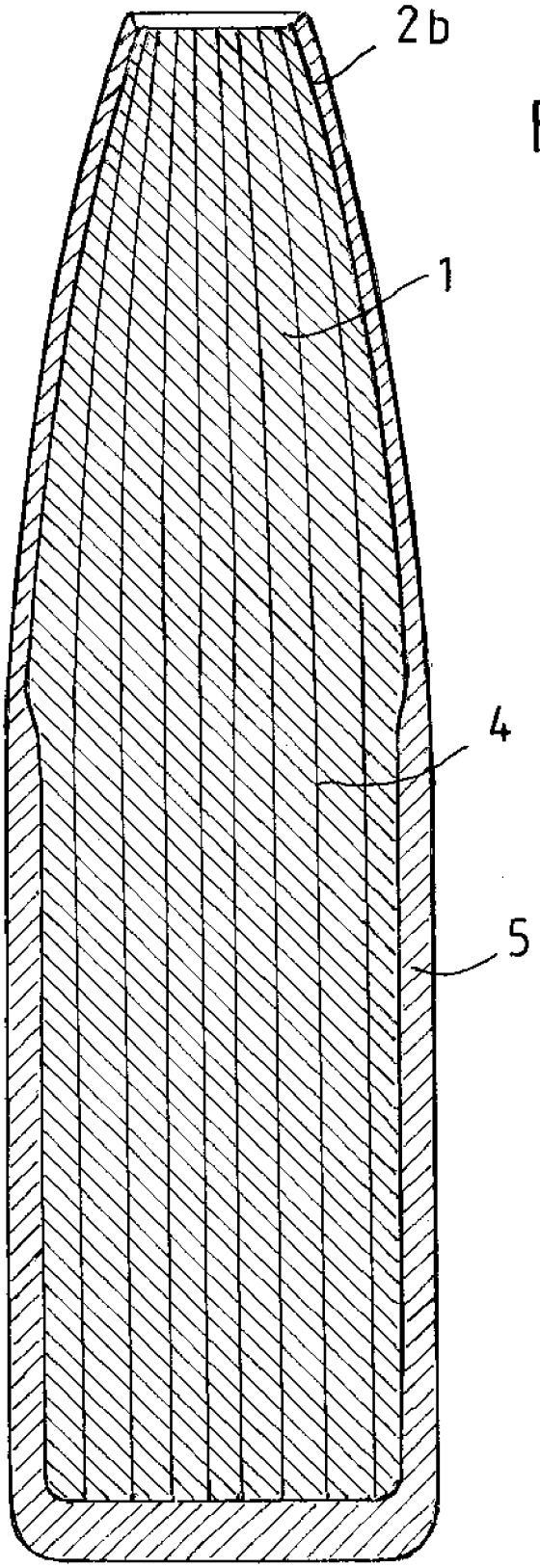
FIG. 5 shows a dividing projectile that has a core interspersed with predetermined breaking points.

FIG. 5 illustrates a jacket projectile in which a single core 1 that has predetermined breaking points 4 is arranged.

Figure 6:
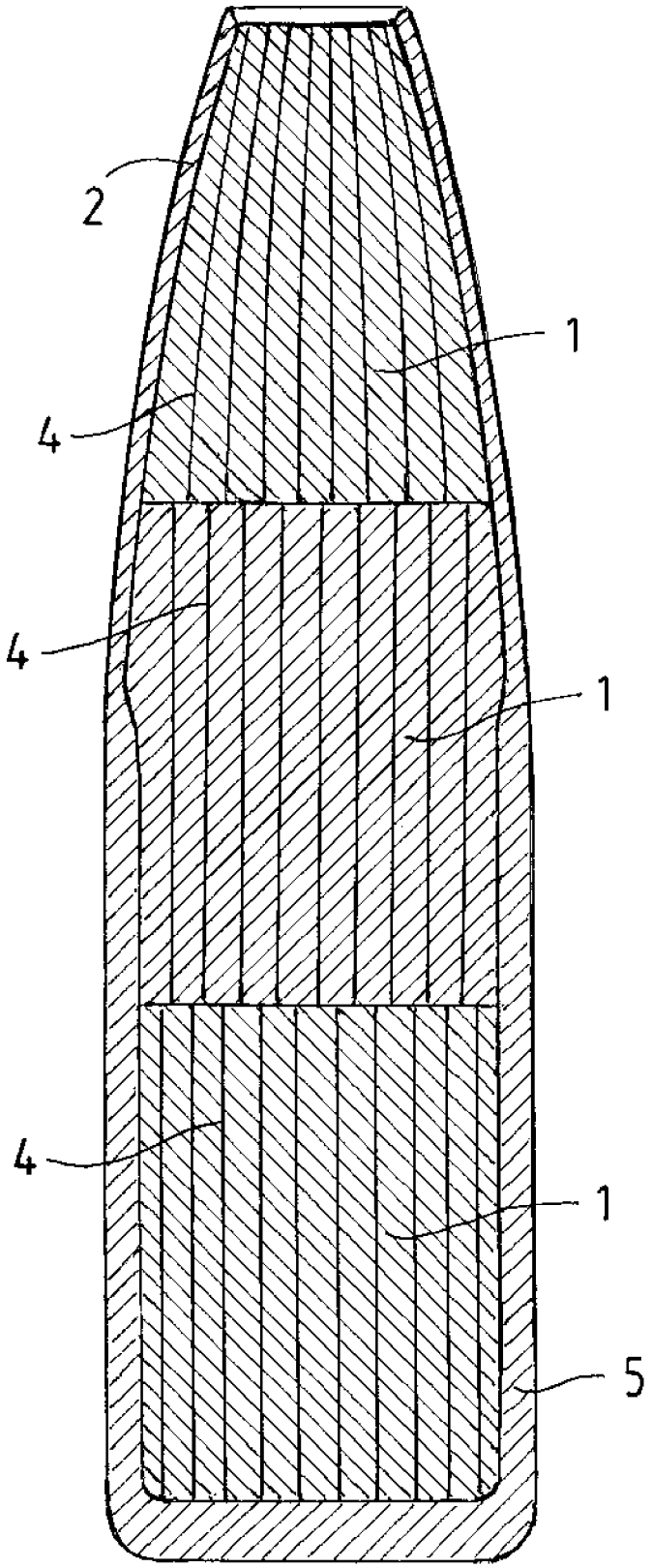
FIG. 6 shows a core comparable to that in FIG. 2. The difference is that a plurality of dividable cores, preferably between 2 and 20 pieces, are arranged on top of each other and are pressed together.

FIG. 6 illustrates a jacket projectile in which three cores 1 that have predetermined breaking points 4 are arranged. As in FIG. 5, no solid core without predetermined breaking points is arranged in the projectile.

FIGS. 7*a* to 7*c* show endless wires or wire sections 12 with different cross-sections with incorporated geometrical shapes. FIG. 7*a* shows nine holes or channels 9 formed therein. All holes or channels 9 have the same diameter, wherein a central hole or a central channel 9 is surrounded by eight holes or channels 9. FIG. 7*b* shows four slots 7 formed therein and FIG. 7*c* shows eight slots 10 on the outer wire diameter 11.

The dividing of a projectile in the target body, in particular of a hunting projectile in the game body after penetrating into the game body, determines the energy output and thus the effect of the shot. A compressed projectile core from Pb-free material held by the projectile jacket and interspersed with predetermined breaking points divides itself together with the projectile jacket upon impact on the target body. The size of the individual parts determines the energy output and the predetermined breaking points in the projectile core determine the size of individual parts that result from the dividing of the projectile core and thus determine the effect of the projectile.

FIG. 8 shows a projectile core 1 that has predetermined breaking points 4 running in the longitudinal or axial direction, which predetermined breaking points protrude completely through the projectile core 1. The dividing rate is 100%.

FIG. 9 shows a projectile core 1 that has predetermined breaking points 4 running in the longitudinal or axial direction, which predetermined breaking points protrude into the projectile core 1 in the longitudinal direction or axial direction only up to a depth of 10%. The dividing rate is 10%.

FIG. 10 shows a projectile jacket 5 with a projectile core 1 that is compressed in the projectile jacket and has predetermined breaking points 4 extending in the longitudinal direction and a dividing rate of 10%.

FIG. 11 shows a projectile jacket 5 with a projectile core 1 that is compressed in the projectile jacket 5 and has predetermined breaking points 4 extending in the longitudinal direction and a dividing rate of 100%.

The invention claimed is:

1. A method comprising the steps of:

compressing a wire or wire section wherein the wire or wire section comprises a lead-free material to form a core for a projectile, wherein prior to the compressing the wire or wire section has holes in an interior of the core of the wire or wire section, wherein said holes have the same diameter and, wherein the core is cavity-free.

2. A method according to claim 1, wherein there are nine said holes, wherein one of said holes is a central hole and is surrounded by eight holes.

3. A method for producing a core for a projectile, comprising the steps of:

compressing a wire section wherein the wire section comprises a lead-free material to form a core, wherein prior to the compressing the wire section has holes in an interior of the core of the wire section, wherein said holes have the same diameter, wherein after said compressing the holes no longer remain in the core and the core is cavity-free.

* * * * *